US005460266A

United States Patent [19]

Mundorf et al.

[11] Patent Number: 5,460,266

[45] Date of Patent: Oct. 24, 1995

[54] SECURITY PACKAGE

[75] Inventors: Larry K. Mundorf, North Canton; James T. Weisburn, Massillon; David A. Houk, Jr., Norton, all of Ohio

[73] Assignee: Alpha Enterprises, Inc., North Canton, Ohio

[21] Appl. No.: 275,805

[22] Filed: Jul. 15, 1994

[51] Int. Cl.[6] ..... B65D 85/57; B65D 85/67

[52] U.S. Cl. ..... 206/309; 206/807; 206/1.5; 206/308.2; 206/387.11

[58] Field of Search ..... 206/807, 1.5, 307, 206/309, 387

[56] References Cited

U.S. PATENT DOCUMENTS

| | | | |
|---|---|---|---|
| 4,589,549 | 5/1986 | Hehn | 206/387 |
| 4,760,914 | 8/1988 | Gelardi et al. | 206/807 X |
| 4,951,814 | 8/1990 | Belmont | 206/387 |
| 5,211,283 | 5/1993 | Weisburn et al. | 206/1.5 |
| 5,215,188 | 6/1993 | Wittman | 206/807 X |
| 5,297,672 | 3/1994 | MacTavish | 206/807 X |

*Primary Examiner*—David T. Fidei
*Assistant Examiner*—Ted Kavanaugh
*Attorney, Agent, or Firm*—Michael Sand Co.

[57] ABSTRACT

A reusable plastic package for holding a rectangular article includes a housing having first and second rectangular-shaped storage compartments formed on opposite ends for selectively storing an article in one of the compartments. Each of the compartments has an access opening for inserting and removing the article into and out of the compartments. The longitudinal length and transverse width of the first compartment is substantially equal to the transverse width and longitudinal length, respectively, of the second compartment, thereby enabling the article to be stored in various orientations in the selected compartments. A lock compartment is formed between the storage compartments, and a slide plate is slidably mounted thereon and selectively movable across the access openings of the storage compartments between locked and unlocked positions for releasably securing the article in one of the storage compartments. Locking levers and mating projections are formed within the lock compartment when the slide plate is in a selected locked position for securing the slide plate in the locked position. A key disengages the locking levers from the projections to enable the slide plate to be moved to the unlocked position. The locking levers and projections are offset in the locking compartment to provide space for an electronic article surveillance tag.

20 Claims, 5 Drawing Sheets

FIG. 6
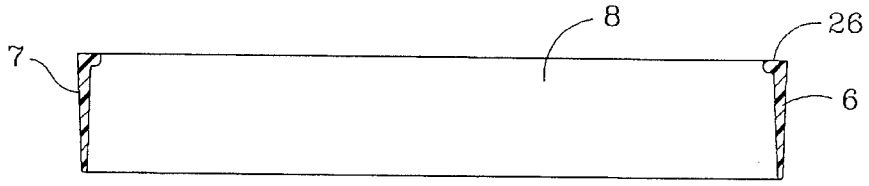
FIG. 7
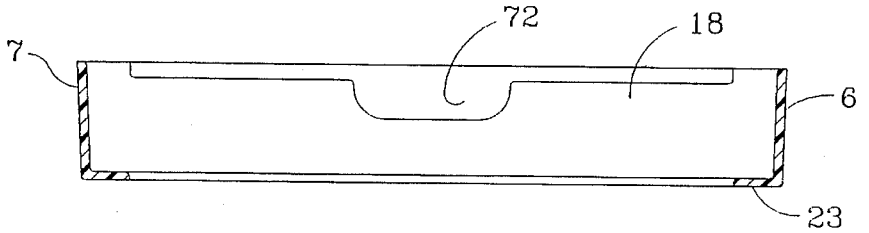
FIG. 8
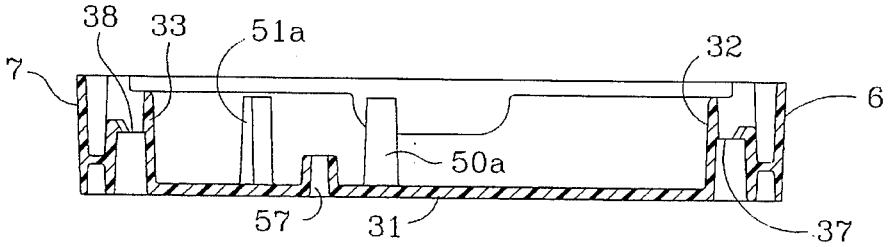
FIG. 9
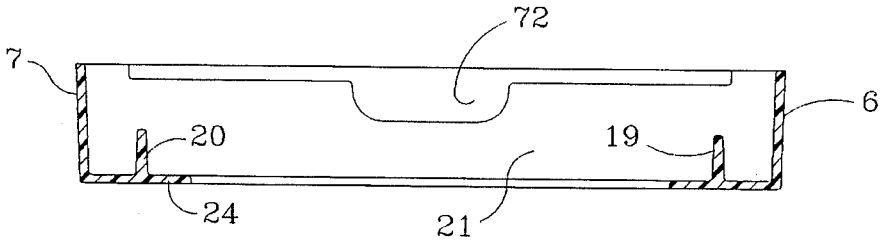
FIG. 10
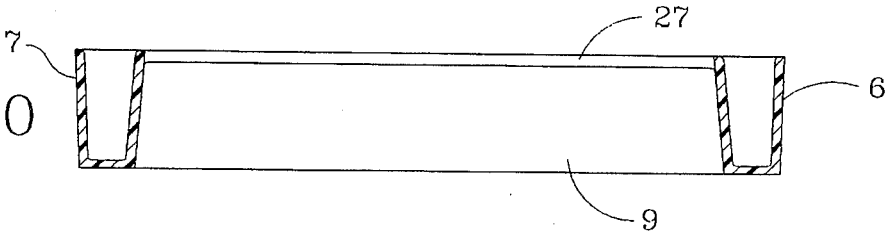
PRIOR ART
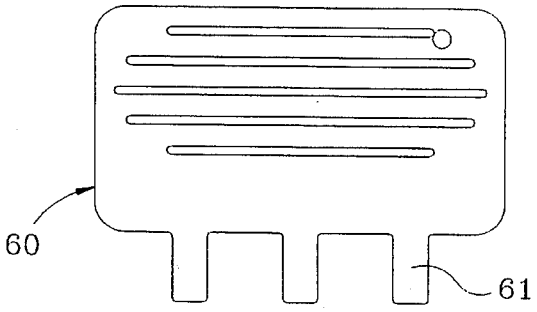
FIG. 14
PRIOR ART
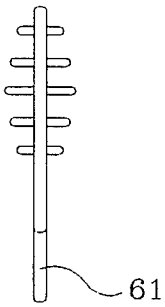
FIG. 15

SECURITY PACKAGE

BACKGROUND OF THE INVENTION

1. Technical Field

The invention relates to packages and in particular to a package for securely holding a rectangular-shaped article therein. More particularly, the invention relates to a reusable security package preferably for recorded media, which can be stored in either end of the package and oriented 90° with respect to each of the storage compartments.

2. Background Information

In recent years, recorded media such as audio cassettes, compact discs, digital audio tapes, and mini discs (MD) have become increasingly popular, almost entirely replacing record disc sales and 8-track audio tapes. The introduction of these recorded media into the marketplace presents a problem to the retail sellers in that these recorded media are considerably smaller than the heretofore used 8-track tapes and record discs, but still have to be displayed so that prospective purchasers can inspect the same to determine the artist, songs, etc. on the recorded media. This presents a security problem due to the extremely small size of the recorded media.

Therefore, it has become important that the recorded media, which are usually contained within their own outer plastic package or box, be repackaged in an outer security package to prevent their theft from the display cases used in most retail businesses. Various types of display and security containers have been developed for recorded media, such as shown in U.S. Pat. Nos. 4,759,442, 4,381,836, 4,881,645, 3,871,516, 4,834,238, 4,285,429, 4,589,549, 4,951,814 and 5,205,401.

Although these prior art security packages for the various types of cassettes and recorded media have proven satisfactory for many applications, they present one major problem, that is, the recorded medium can usually only be displayed in a single orientation in the security package. Although this may be satisfactory for certain display cases and racks, it may be unsatisfactory for other racks, since the recorded medium is not properly oriented to enable the prospective purchaser to review the printed material on the graphics contained with most recorded media. Since these display cases can involve a substantial outlay of money by the store owner, they cannot be readily replaced, and it is therefore desirable that the racks be used for display of various recorded media.

Therefore, the need exists for an improved security package for various types of cassettes and recorded media in which the recorded media are maintained in their usual display boxes, but when placed in the security package, can be oriented in different positions so that they are able to be displayed in existing display racks in order to provide for the ease of review by a prospective purchaser of the graphics describing the contents of the recorded media.

SUMMARY OF THE INVENTION

Objectives of the invention include providing an improved security package which can be mass produced relatively inexpensively as a two-piece molded plastic member, one piece of which forms the main housing and the other piece being a lock plate slidably mounted on the housing for securing a rectangular-shaped article in a selected pair of storage compartments which are located at the ends of the housing, and which can be manually loaded by retail shop personnel for subsequent sale, and which can be unloaded easily at the point of sale.

Another objective of the invention is to provide such a security package in which printed information on the stored article is visible through enlarged openings formed in the walls of the housing which form the storage compartments, and in which the article to be stored is slid easily into one of the selected end storage compartments and secured therein by the easily operated manual slide plate which is selectively moved over the access opening of the storage compartments to prevent unauthorized removal of the article from within the storage compartments.

A further objective of the invention is to provide such a security package in which an inexpensive key formed of molded plastic is insertable into openings formed in the housing and/or slide plate, whereby the slide plate can be moved to an unlocked position permitting the stored article to be manually removed from either of the end storage compartments upon completion of a sale, enabling the package to be reused for storing another article for sale.

A still further objective is to provide such a package which can be molded of rugged plastic material and repeatedly reused, thereby reducing the cost to a manufacturer and/or distributor of the articles to be stored therein, such as audiocassettes, compact discs, etc.

Another objective of the invention is to provide such a security package in which the longitudinal length and transverse width of one of the end storage compartments is substantially equal to the transverse width and longitudinal length, respectively, of the other end compartment, thereby enabling the stored article to be rotated 90° depending upon which of the compartments is used to display and store the article, thereby enabling the retailer to display the article in the most desirable position.

A further objective of the invention is to provide such a security package in which a neutral position is provided for the slide plate, wherein the slide plate is out of locking engagement with both of the end storage compartments at the same time, to enable an article to be placed in either of the storage compartments without first moving the slide plate to a complete unlocked position.

Still another objective of the invention is to provide such a security package in which an end of the slide plate opposite of a locking edge is aligned with an end wall of a lock compartment when the slide plate is in a locked position, preventing the formation of a lip which could be grasped to enable the slide lock to be pried from the housing to steal a stored article from the package.

A further objective of the invention is to provide such a security package in which locking levers and projections are located within the lock compartment and are offset with respect to the longitudinal axis of the lock compartment, thereby enabling another portion of the compartment to be void for the placement and storage of an electronic article surveillance tag therein.

Another objective of the invention is to provide such a security package which is of an extremely simple construction, which achieves the stated objectives in a simple, effective, and inexpensive manner, and which solves problems and satisfies needs in the art.

These and other objectives and advantages are obtained by the improved security package of the invention, the general nature of which may be stated as including a housing having first and second rectangularly shaped storage compartments formed on opposite ends of said housing for selectively storing the article, each of said compartments having an access opening for inserting and removing the article into and out of said compartment, wherein the longitudinal length and transverse width of said first compartment is substantially equal to the transverse width and longitudinal length, respectively, of the second compartment; a lock compartment formed between the first and second storage compartments; a slide plate slidably mounted on the lock compartment and selectively movable across at least a portion of the access openings of the first and second storage compartments between locked and unlocked positions, for releasably securing the article in a selected one of the storage compartments; and lock means within the lock compartment for releasably securing the slide plate in locked position with the selected storage compartment.

BRIEF DESCRIPTION OF THE DRAWINGS

A preferred embodiment of the invention, illustrative of the best mode in which applicants have contemplated applying the principles, are set forth in the following description and are shown in the drawings and are particularly and distinctly pointed out and set forth in the appended claims.

FIG. 6 is an enlarged sectional view taken on line 6—6, FIG. 1;

FIG. 7 is an enlarged sectional view taken on line 7—7, FIG. 1;

FIG. 8 is an enlarged sectional view taken on line 8—8, FIG. 1;

FIG. 9 is an enlarged sectional view taken on line 9—9, FIG. 1;

FIG. 10 is an enlarged sectional view taken on line 10—10, FIG. 1;

FIGS. 14 and 15 are elevational views showing one type of prior art key for use with the security container of the present invention;

Similar numerals refer to similar parts throughout the drawings.

DESCRIPTION OF THE PREFERRED EMBODIMENT

The improved security package of the present invention is indicated generally at 1, and includes a main housing 2 which is formed as an integral one-piece plastic member, preferably of a high-impact polystyrene. It has an elongated, generally rectangular configuration, and is formed with a pair of end storage compartments, indicated at 3 and 4. Housing 2 includes a pair of longitudinally extending side walls 6 and 7 which extend throughout the longitudinal length of housing 2, and a pair of parallel end walls 8 and 9 which extend between and are perpendicular to side walls 6 and 7.

Figure 2:
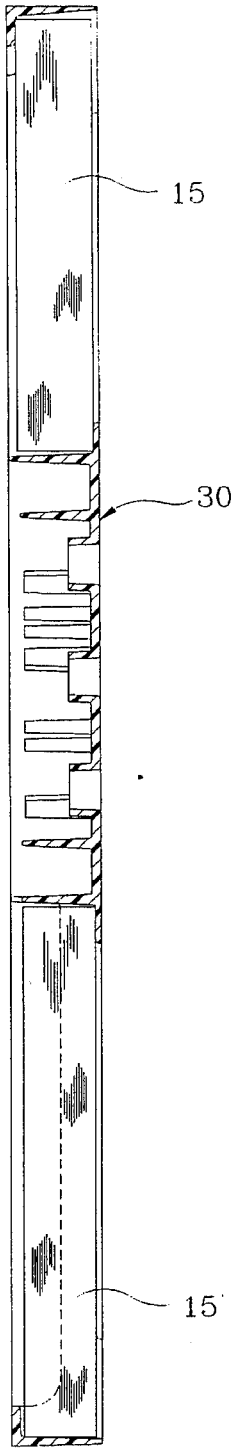
FIG. 2 is a longitudinal sectional view taken on line 2—2, FIG. 1.

In accordance with one of the main features of the invention, the transverse width 11 and longitudinal length 12 of storage compartment 3 are substantially equal to the longitudinal length 13 and transverse width 14, respectively, of storage compartment 4. This enables a rectangular-shaped article 15 to be placed in a selected orientation in either of the storage compartments (FIG. 2), depending upon the most advantageous manner for displaying the article and its contents in a storage rack or display shelf. Thus, article 15 may have two different orientations when placed in compartment 3, and then will have two other orientations by being rotated 90° when placed in storage compartment 4.

Storage compartment 3 is formed by end portions of housing side walls 6 and 7 and end wall 8, and an end storage compartment forming wall 18. On the other end, storage compartment 4 is formed by main housing end wall 9 and a pair of spaced parallel half side walls 19 and 20 (FIG. 1), and a storage compartment forming end wall 21. Half side walls 19 and 20 are parallel with and are spaced inwardly from adjacent portions of housing walls 6 and 7, and end wall 21 is parallel with end wall 9.

Figure 1:
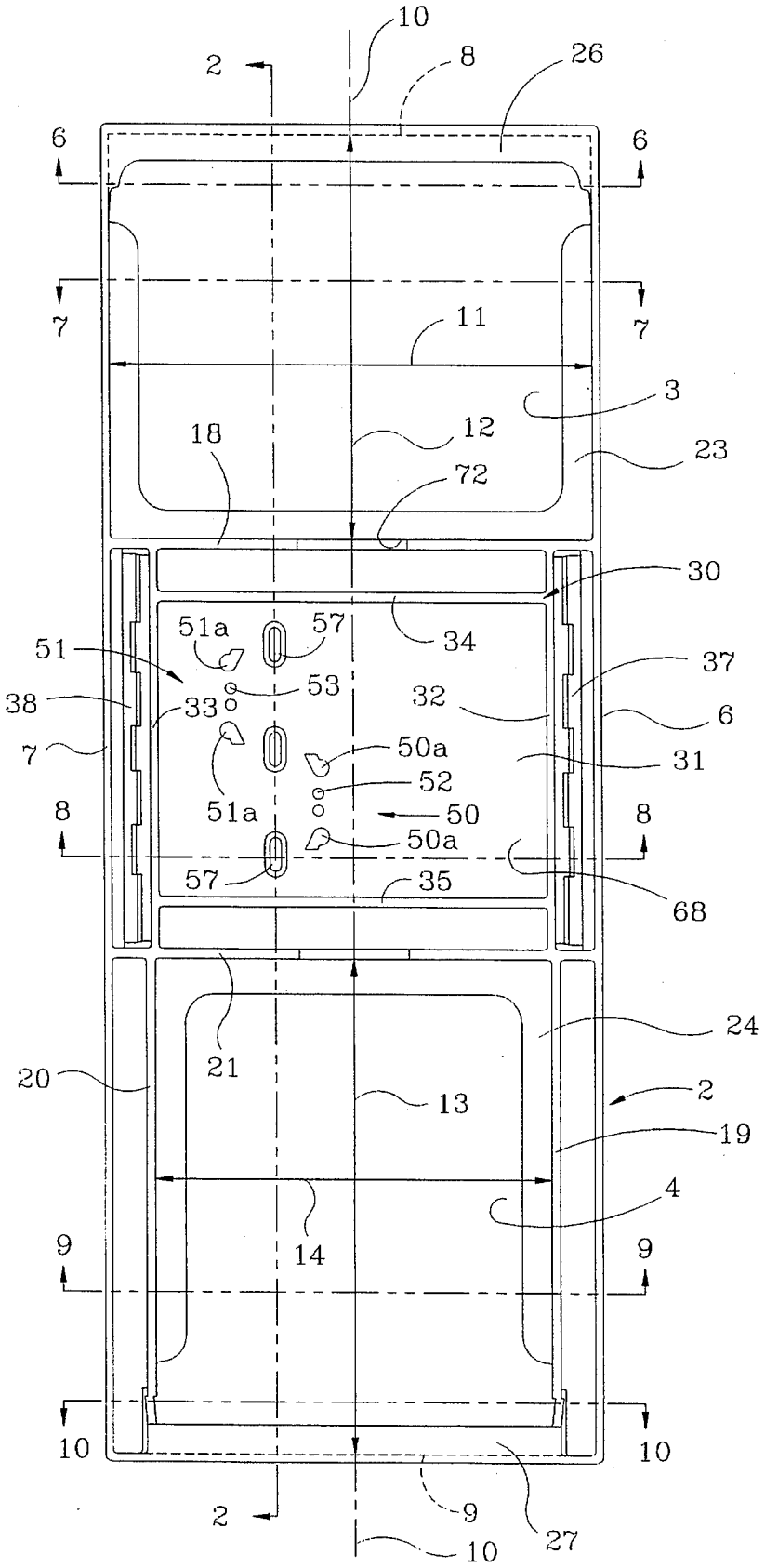
FIG. 1 is a top plan view of the security package with the locking slide plate removed therefrom.

Storage compartments 3 and 4 include U-shaped bottom walls 23 and 24 (FIG. 1). End flanges 26 and 27 are formed integrally with and extends inwardly from end walls 8 and 9, respectively, and form lips, which in combination with U-shaped bottom walls 23 and 24, assist in retaining a rectangular-shaped article 15 within the respective storage compartments.

A generally centrally located lock compartment, indicated generally at 30, is formed between storage compartments 3 and 4, and includes a bottom wall 31 and a pair of spaced parallel side walls 32 and 33 (FIG. 1), and a corresponding pair of spaced parallel end walls 34 and 35. Side walls 32 and 33 are spaced inwardly from and are parallel with adjacent portions of housing side walls 6 and 7, and are generally longitudinally aligned with half side walls 19 and 20 of storage compartment 4. A pair of slide rails 37 and 38 are located between lock compartment side walls 32 and 33 and housing side walls 6 and 7, and are provided with notches for slidably receiving and mounting a slide plate 40 thereon.

Figure 3:
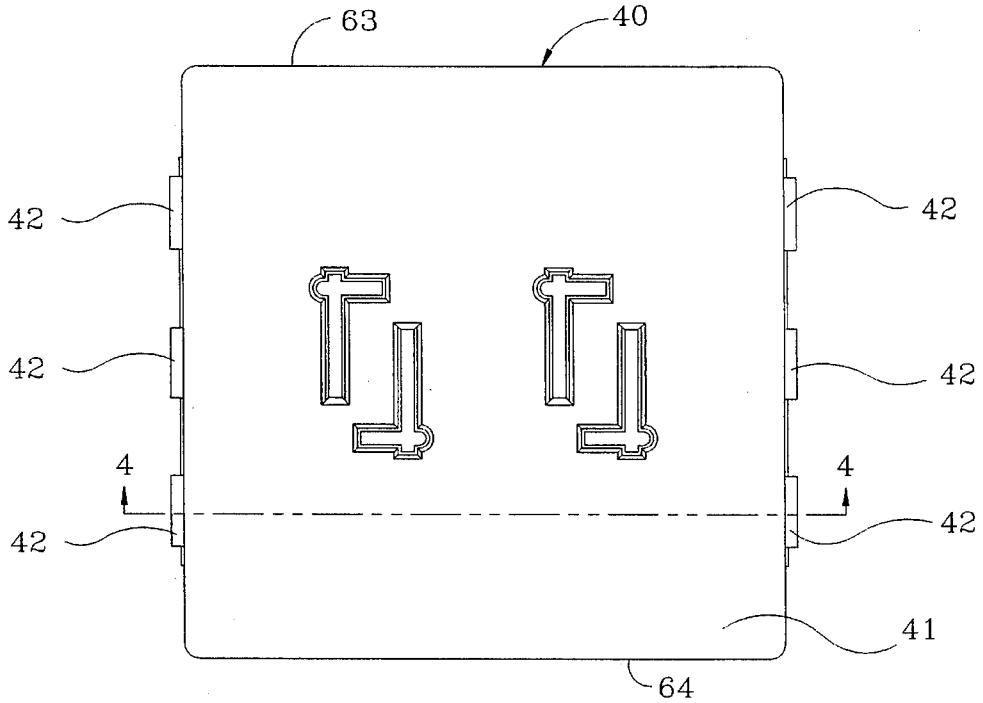
FIG. 3 is a top plan view of the locking slide plate.
Figure 4:
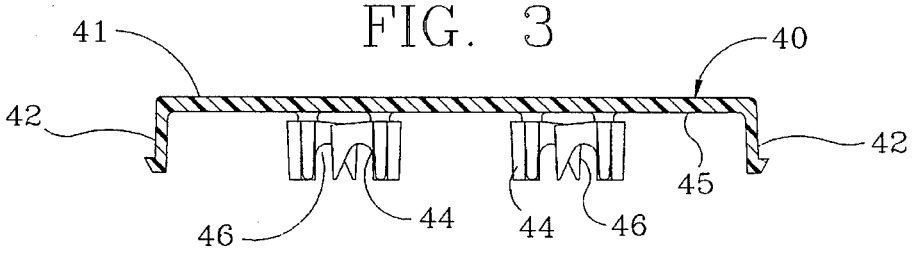
FIG. 4 is a transverse sectional view taken on line 4—4, FIG. 3.
Figure 5:
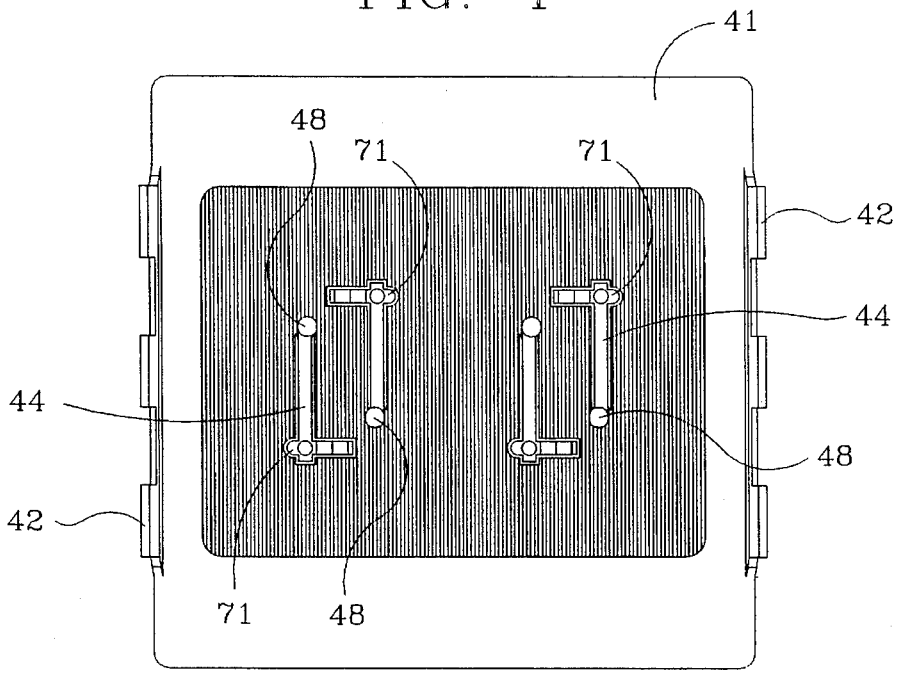
FIG. 5 is a bottom plan view of the slide plate of FIG. 3.

Slide plate 40 is shown particularly in FIGS. 3–5, and includes a generally rectangular-shaped planar wall 41, which is formed with a plurality of slide flanges 42, which extend perpendicularly outwardly from wall 41, and are adapted to extend through the notches of slide rails 37 and 38 for slidably mounting slide plate 40 on lock compartment 30. Two pairs of locking levers 44 are formed on and extend outwardly from bottom surface 45 of slide plate 40, and include camming slots 46 at the swinging ends of the levers. The opposite ends of the levers include a post-like member 48 (FIG. 5) for pivotally mounting the levers on bottom surface 45 of slide plate 40.

Referring to FIG. 1, two pairs of projections, indicated generally at 50 and 51, are formed on bottom wall 31 of lock compartment 30 and project into the interior of the lock compartment, each of which has an irregular, somewhat tear-shaped configuration. Each projection pair includes a pair of projections, individually indicated as **50*a* and 51*a*. A pair of spaced posts 52 and 53 are formed between the spaced projections of projection pairs 50 and 51, respectively. In accordance with one of the features of the invention, projection pairs 50 and 51 are spaced transversely with respect to the longitudinal axis 55 of package 1, for reasons described below. A plurality of elongated openings 57 are formed in housing bottom wall 31, with the center opening being adjacent projections 50***a* and 51a, and with the two outer openings being adjacent another pair of projections 50*a* and 51*a*.

Figure 11:
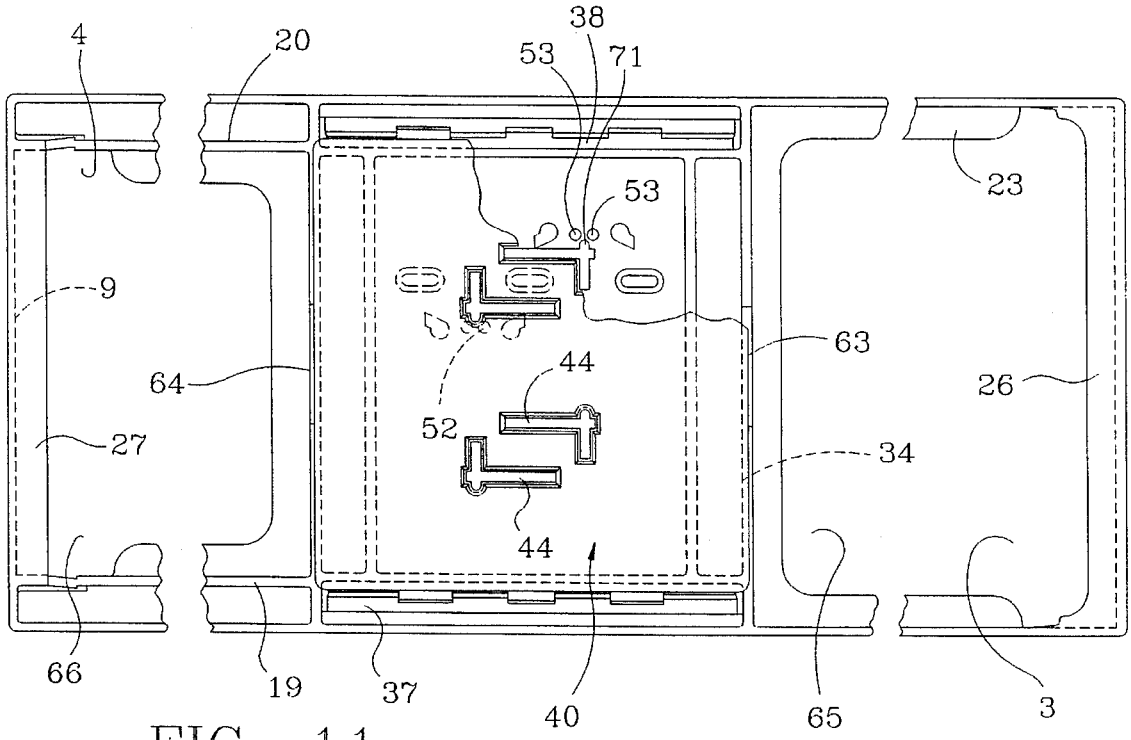
FIG. 11 is a top plan view with portions broken away, showing the slide plate in a neutral position.
Figure 12:
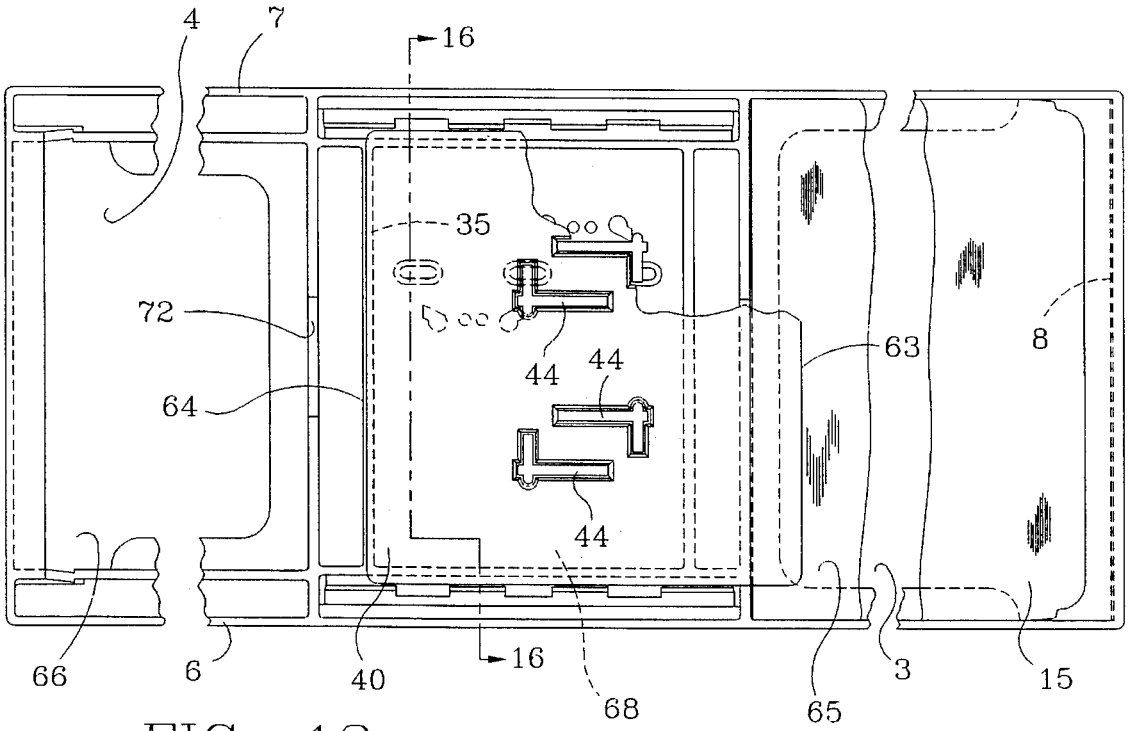
FIG. 12 is a view similar to FIG. 11 showing the slide plate in locked position with the right-hand end storage compartment.
Figure 16:
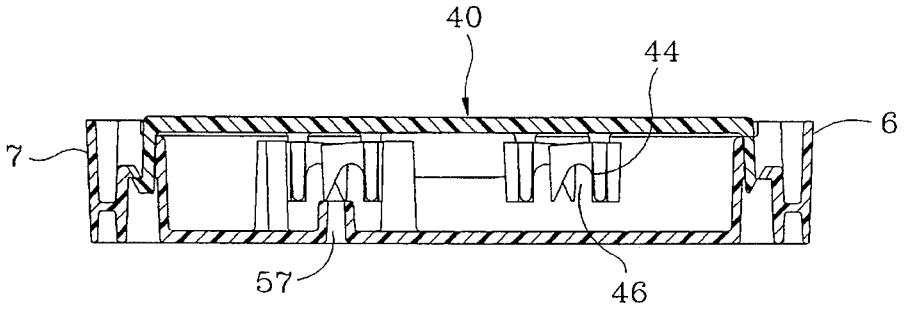
FIG. 16 is a sectional view taken on line 16—16, FIG. 12, showing the locking projections and levers in a locked position.
Figure 17:
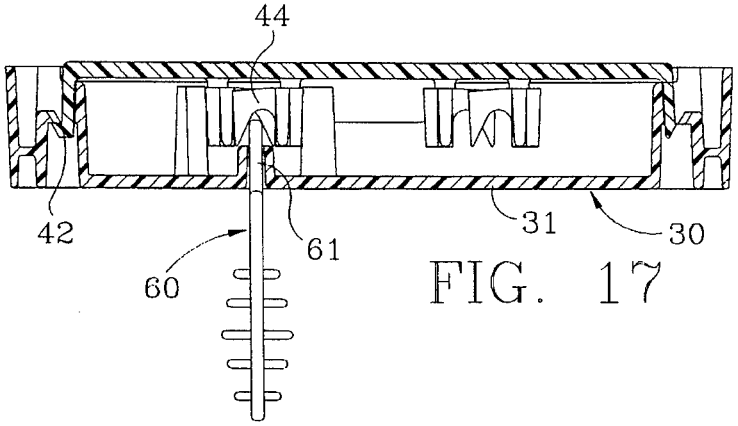
FIG. 17 is a sectional view similar to FIG. 16 showing the unlocking key of FIGS. 14 and 15 moving the locking levers to an unlocked position.
Figure 13:
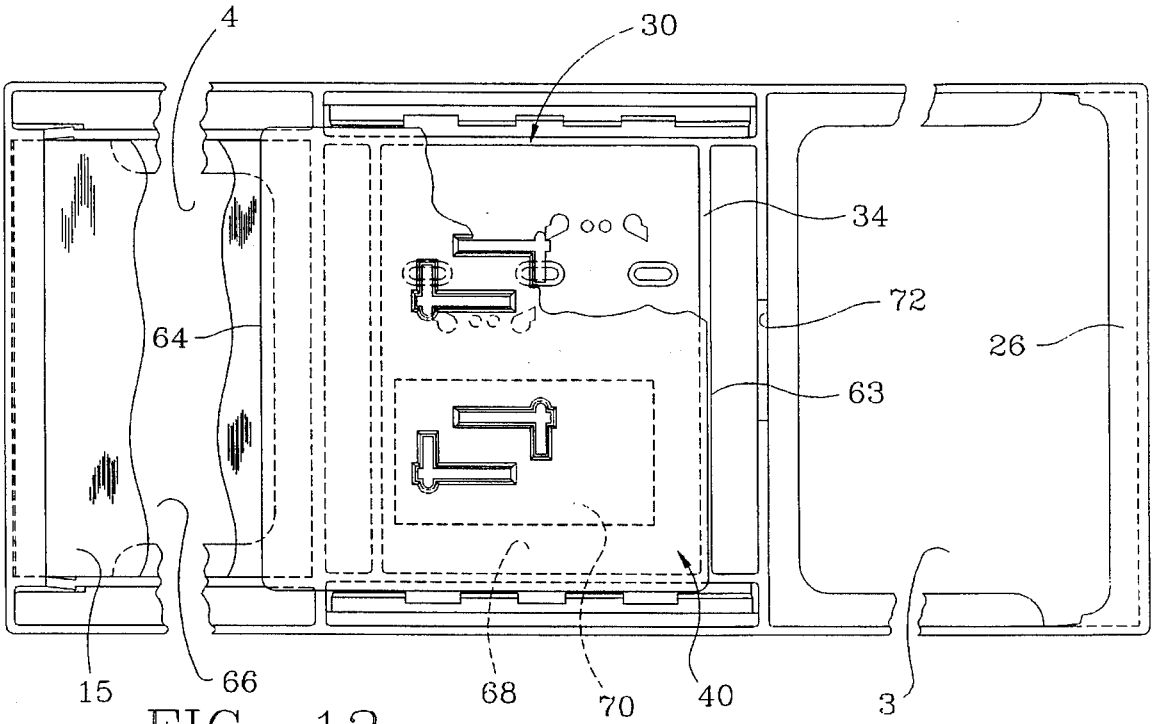
FIG. 13 is a view similar to FIGS. 11 and 12 showing the slide plate in locking position with the left-hand end storage compartment.

Many of the features and general construction of package 1, including certain features of the locking projections and slide plate, are shown and described in greater detail in U.S. Pat. No. 4,589,549, the contents of which are incorporated herein by references. A key 60, shown in FIGS. 14 and 15, is of the type shown in the above-referenced U.S. Pat. No. 4,589,549 and includes three unlocking fingers 61 which extend through openings 57 and into camming slots 46 of locking levers 44 for moving the levers out of engagement with a selectively engaged projection of projection pairs 50 and 51, as shown particularly in FIG. 17 and also described in U.S. Pat. No. 4,589,549, enabling slide plate 40 to be moved from a locked position, as shown in FIGS. 12 and 13, to an unlocked or neutral position, as shown in FIG. 11. When in a selected locked position, an outer edge 63 or 64 of plate 40 extends across an access opening 65 or 66, respectively, of storage compartments 3 and 4, to secure an article 15 in one of the storage compartments. The complete operation and movement of slide plate 40 is described in detail in the above-referenced U.S. Pat. No. 4,589,549.

The particular construction of security package 1 has a number of advantages over known prior art security packages. As indicated previously, an article 15 can be oriented in two different positions and secured in the package, as shown particularly in FIGS. 12 and 13. The particular orientation depends upon the particular storage compartment selected for the storage of the article. This enables the retail marketer to place the article to be displayed in the most advantageous position, depending upon the particular orientation of the security package in a shelf or display rack.

Another advantage is provided by the transverse offset orientation of the locking mechanism with respect to lock compartment 30. As shown in FIG. 1 and in FIGS. 11–13, the various locking projections and locking levers are transversely offset with respect to longitudinal axis 10 of housing 2, as well as key-receiving openings 57. This provides for a void area 68 for receiving an electronic article surveillance tag (EAS) therein, as shown in FIG. 13 and represented by numeral 70. These tags can take various shapes and sizes, but due to the offset location of the lever-engaging projections, a sufficiently large void area 68 is provided within lock compartment 30 for receiving various sizes of EAS tags.

Another feature provided by improved security package 1 is shown in FIG. 11, wherein slide plate 40 is in a neutral position wherein neither outer edge 63 or 64 extends across access openings 65 or 66 of storage compartments 3 and 4, thereby enabling either compartment to be filled with an article 15 without requiring movement of the slide plate. In this position, a small nub 71 formed on the free or swinging end of lever 44, will be positioned between spaced posts 52 and 53, which assist in retaining plate 40 in the neutral position until it is manually moved by an individual or automatic loader to either of the locked positions of FIGS. 12 and 13.

In accordance with another feature of the invention, as can be visualized from viewing FIGS. 11–13, a second pair of levers 44 is provided on slide plate 40, which enables slide plate 40 to be mounted in either position on lock compartment 30, thereby facilitating the assembling of security package 1. Furthermore, this extra set of locking levers 44 provides some concealment for the EAS tag 70 which is located generally beneath these unused levers within the lock compartment.

A further feature of security package 1 is shown in FIGS. 12 and 13, whereby edge 64 of slide plate 40 will align with storage compartment end wall 35, as shown in FIG. 12, when locking edge 63 extends over access opening 65 to secure an article 15 in storage compartment 3. Likewise, as shown in FIG. 13, slide plate edge 63 aligns with storage compartment end wall 34 when edge 64 extends over access opening 16 of storage compartment 4 to secure an article 15 therein. This relationship of the slide plate edges with the respective end walls of the lock compartment prevents the formation of a lip on the non-locking edge of the slide plate, which, if present, could be easily grasped to permit the slide plate to be pried from its engagement with slide rails 37 and 38 for subsequent theft of an article 15 stored therein.

Each end wall 18 and 21 of the storage compartments is formed with a cutout 72 (FIGS. 7–9) which will enable slide plate 40 to be easily grasped when in the neutral position of FIG. 11, enabling the slide plate to be snapped out of its sliding engagement with slide rails 37 and 38. This permits the slide plate to be temporarily removed for the replacement or removal of an EAS tag into the void area 68 without damaging the slide mechanism.

Likewise, the relatively large open areas provided by U-shaped bottom walls 23 and 24, and the access openings of the storage compartments, enables the various graphics which are contained on most recorded media, to be easily viewed by a prospective purchaser when the recorded medium is locked within one of the selected storage compartments of security package 1.

Another advantage, as shown particularly in FIGS. 11–13, is that the transverse width of the slide plate is as wide as lock compartment 30, and almost as wide as the entire width of security package 1, to provide for increased security by providing a more rigid and sturdy slide plate which is less susceptible to unauthorized removal from the security package housing.

Accordingly, the security package of the present invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved security package is constructed and used, the characteristics of the construction, and the advantageous, new and useful results obtained; the new and useful structures, devices, elements, arrangements, parts and combinations, are set forth in the appended claims.

We claim:

1. A security package for holding and displaying a rectangular-shaped article including:

a) a housing having first and second rectangularly shaped storage compartments formed on opposite ends of said housing for selectively storing the article, each of said compartments having an access opening for inserting and removing the article into and out of said compartment, the longitudinal length and transverse width of said first compartment being substantially equal to the transverse width and longitudinal length, respectively, of the second compartment;

b) a lock compartment formed between the first and second storage compartments;

c) a slide plate slidably mounted on the lock compartment and selectively movable across at least a portion of the access openings of the first and second storage compartments between locked and unlocked positions, for releasably securing the article in a selected one of the storage compartments; and d) lock means within the lock compartment for releasably securing the slide plate in a selected locked position with the selected storage compartment.

2. The security package defined in claim 1 in which each of the storage compartments includes a pair of spaced parallel end walls and a pair of spaced parallel side walls; and in which the lock compartment includes a pair of spaced parallel end walls, each of said lock housing end walls being parallel with and spaced from a respective one of the end walls of the storage compartments.

3. The security package defined in claim 2 in which the slide plate includes a pair of end edges; and in which said end edges generally align with the end walls of the storage compartments when the slide plate is in a neutral position and out of locked position with both of said storage compartments.

4. The security package defined in claim 2 in which each of the slide plate end edges is in alignment with a respective end wall of one of the lock compartments when the other of said end edges is across the access opening of the other storage compartments when the slide plate is in locked position with respect to said other storage compartment.

5. The security package defined in claim 1 in which the lock means includes at least one lever formed on the slide plate and at least one projection formed on the housing and engageable with the lever to retain the slide plate in locked position with a selected storage compartment.

6. The security package defined in claim 5 in which a first pair of projections are provided, each of which selectively engages the lever for retaining the slide plate in locked position with one of the storage compartments.

7. The security package defined in claim 6 in which first post means is located between the first pair of projections and is engageable with the lever for releasably securing the slide plate in a neutral position and out of locked position with both of the storage compartments.

8. The security package defined in claim 7 in which a second pair of projections and second post means are located within the lock compartment and are spaced both longitudinally and transversely from the first pair of projections and the first post means; and in which a second lever is located within the lock compartment and is engageable with the second pair of projections for selectively locking the slide plate in locked position with respect to one of the storage compartments.

9. The security package defined in claim 7 in which a cutout is formed in each of the end walls of the storage compartments to facilitate grasping and removal of the slide plate from the housing when the slide plate is in the neutral position.

10. The security package defined in claim 5 in which the lock compartment and housing have a common longitudinal center axis; and in which the projection and lever are located in a transverse offset relationship with respect to said longitudinal center axis.

11. The security package defined in claim 10 in which the common longitudinal center axis extends through the centers of the two storage compartments.

12. The security package defined in claim 10 in which an electronic article surveillance tag is located within the lock compartment transversely offset from said common longitudinal center axis from the lever and projection.

13. The security package defined in claim 5 in which the lever is formed on the slide plate and the projection is formed integrally with a bottom wall of the lock compartment and projects towards the slide plate.

14. The security package defined in claim 5 including a separate key engageable with the lever for moving said lever out of engagement with the projection, enabling the slide plate to be moved from locked position for removing an article from one of the storage compartments.

15. The security package defined in claim 14 in which opening means is formed in a bottom wall of the lock compartment for insertion of the key therethrough for engagement with the lever when the slide plate is in locked position to disengage the lever from the projection, enabling the slide plate to be moved from the locked position to the unlocked position.

16. The security package defined in claim 15 in which a pair of spaced projections is formed in the lock compartment and project toward an interior thereof; and in which a pair of levers is located within the lock compartment and is engageable with the pair of projections for retaining the slide plate in locked position.

17. The security package defined in claim 16 in which a nub is formed on a swinging end of each of the levers for engagement with the locking projections to secure the slide plate in a selected locked position.

18. The security package defined in claim 1 in which the housing includes a pair of spaced parallel side walls and a pair of spaced parallel end walls; and in which one of the storage compartments includes a pair of spaced parallel side walls which extend parallel with and are spaced inwardly from a portion of the housing side walls.

19. The security package defined in claim 18 in which the lock compartment includes a pair of spaced parallel side walls which are parallel with and spaced inwardly from a portion of the housing side walls.

20. The security package defined in claim 1 in which the housing is a one-piece plastic member.

* * * * *